US008750751B2

(12) United States Patent
Nakai et al.

(10) Patent No.: US 8,750,751 B2
(45) Date of Patent: Jun. 10, 2014

(54) IMAGE FORMING APPARATUS AND TONER SUPPLY DEVICE

(75) Inventors: Daisuke Nakai, Kanagawa (JP); Takashi Sakamoto, Kanagawa (JP); Hiroaki Okuma, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 202 days.

(21) Appl. No.: 13/474,950

(22) Filed: May 18, 2012

(65) Prior Publication Data

US 2013/0108327 A1 May 2, 2013

(30) Foreign Application Priority Data

Oct. 27, 2011 (JP) ..... 2011-236375

(51) Int. Cl.
*G03G 15/08* (2006.01)

(52) U.S. Cl.
CPC .... *G03G 15/0886* (2013.01); *G03G 2215/0692* (2013.01)
USPC ..... 399/106

(58) Field of Classification Search
CPC ..... G03F 2215/067; G03F 2215/0692; G03F 15/0886
USPC ..... 399/105, 106
See application file for complete search history.

(56) References Cited

U.S. PATENT DOCUMENTS 7,920,811 B2 * 4/2011 Murase et al. ..... 399/162
8,160,481 B2 * 4/2012 Kitagawa et al. ..... 399/258
8,483,599 B2 * 7/2013 Okuma et al. ..... 399/260

FOREIGN PATENT DOCUMENTS

JP 2003-107871 A 4/2003

* cited by examiner

*Primary Examiner* — David Gray
*Assistant Examiner* — Gregory H Curran
(74) *Attorney, Agent, or Firm* — Sughrue Mion, PLLC

(57) ABSTRACT

An image forming apparatus includes an image carrier, a developing device, a toner container, a container support member, a toner supply unit, a transfer device, a fixing device, and a restricting mechanism. The toner container includes a container housing having a container opening, a sealing member having a hole that communicates with the container opening, and a shutter member. The shutter member is slidable between a closed position and an open position at which a front end portion of the shutter member in an attachment direction at least partially overlaps with the sealing member. When the shutter member is at the open position, the front end portion is pressed in a direction away from the toner container by the sealing member, and the restricting mechanism restricts a position of a back end portion of the shutter member, the back end portion is opposed to the front end portion.

5 Claims, 8 Drawing Sheets

IMAGE FORMING APPARATUS AND TONER SUPPLY DEVICE

CROSS-REFERENCE TO RELATED APPLICATIONS

This application is based on and claims priority under 35 USC 119 from Japanese Patent Application No. 2011-236375 filed Oct. 27, 2011.

BACKGROUND (i) Technical Field

The present invention relates to an image forming apparatus and a toner supply device.

(ii) Related Art

Image forming apparatuses that develop images with toner generally include a detachable toner container from which toner is supplied in accordance with an amount of toner consumption. The toner container is pulled out for maintenance or when the toner container becomes empty. The toner container has a shutter that closes an opening in the toner container to prevent leakage of the toner when the toner container is pulled out. However, there is still a risk that the toner will leak and contaminate the apparatus when the shutter is closed.

SUMMARY

According to an aspect of the invention, there is provided an image forming apparatus including an image carrier, a developing device, a toner container, a container support member, a toner supply unit, a transfer device, a fixing device, and a restricting mechanism. A latent image is formed on the image carrier. The developing device develops the latent image formed on the image carrier with the toner. The toner container contains toner to be supplied, and is attached to a container support member by being moved in an attachment direction and detached from the container support member by being moved in a detachment direction that is opposite to the attachment direction. The container support member supports the toner container that has been attached to the container support member. The toner supply unit supplies the toner contained in the toner container to the developing device in accordance with consumption of the toner in the developing device. The transfer device transfers the toner image on the image carrier onto a recording medium. The fixing device fixes the toner image that has been transferred onto the recording medium to the recording medium. The toner container includes a container housing, a sealing member, and a shutter member. The container housing has a container opening through which the toner in the toner container is discharged. The sealing member is elastic and has a hole that communicates with the container opening. The sealing member is disposed in an area surrounding the container opening. The shutter member is slidable between a closed position at which the shutter member closes the container opening and an open position at which the shutter member opens the container opening and at which a front end portion of the shutter member in the attachment direction at least partially overlaps with the sealing member. The shutter member is moved to the open position when the toner container is attached to the container support member, the front end portion being pressed toward a direction away from the toner container by the sealing member when the front end portion partially overlaps with the sealing member. The container support member has a support-member opening that is located so as to communicate with the container opening in the toner container when the toner container is attached to the container support member. When the shutter member is at the open position, the front end portion is pressed in a direction away from the toner container by the sealing member, and the restricting mechanism restricts a position of a back end portion of the shutter member, the back end portion being opposed to the front end portion.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described.

Figure 1:
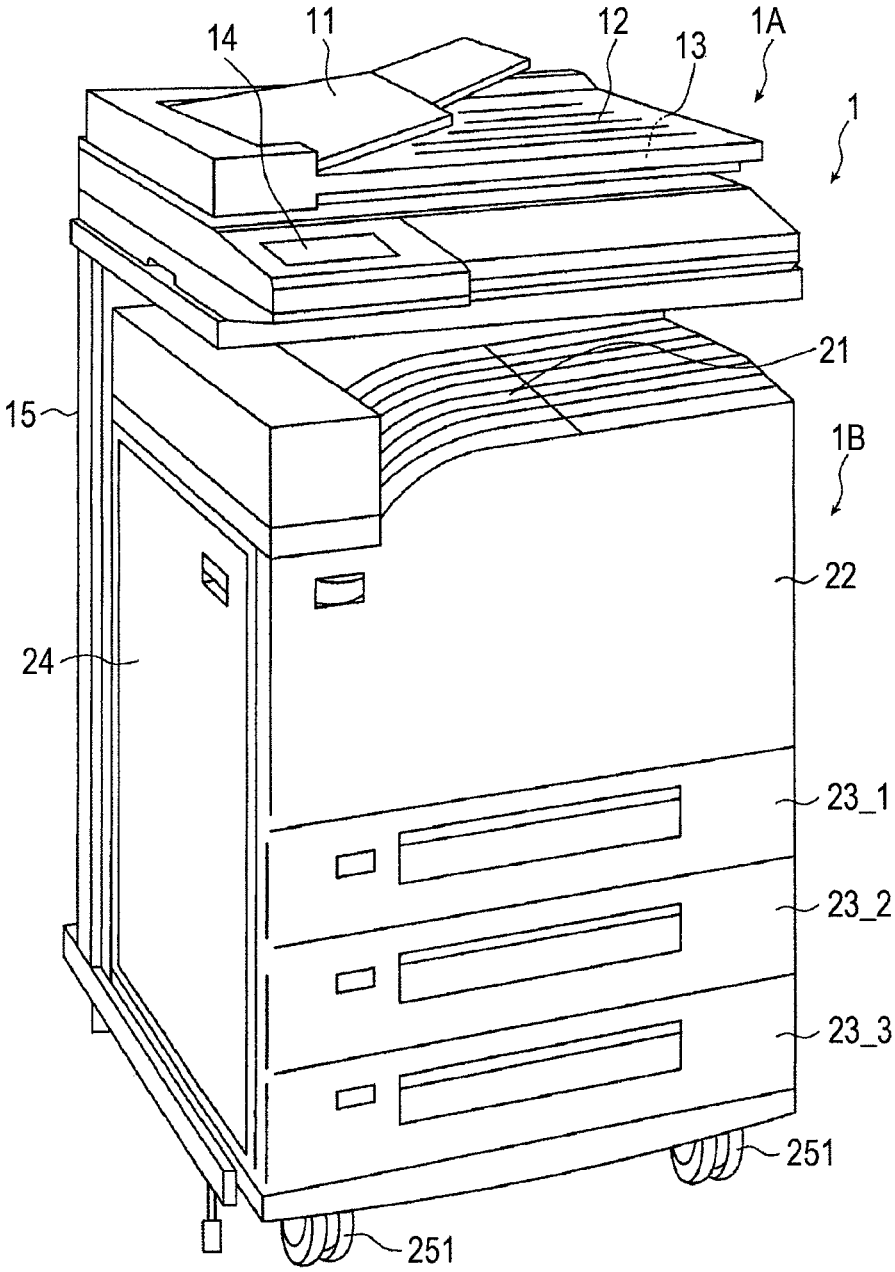
FIG. 1 is an external perspective view of a copier, which is an example of an image forming apparatus.

FIG. 1 is an external perspective view of a copier 1, which is an example of an image forming apparatus.

The copier 1 includes a document reading section 1A and an image forming section 1B.

The document reading section 1A includes a document feed tray 11 on which document sheets are stacked. The document sheets stacked on the document feed tray 11 are fed one by one and ejected onto a document output tray 12 after characters or images recorded on the document sheets are read.

The document reading section 1A also includes a hinge that extends in the left-right direction at the back side. The document feed tray 11 and the document output tray 12 may be lifted together around the hinge. A document reading plate 13 (see FIG. 2) made of transparent glass is disposed under the document feed tray 11 and the document output tray 12. In addition to reading the characters or images from the document sheets placed on the document feed tray 11, the document reading section 1A is also capable of reading characters or images from a single document sheet that is placed on the document reading plate 13 with the side to be copied facing downward.

A display operation unit 14 is provided in front of the document reading plate 13. The display operation unit 14 displays various messages for a user, and also displays various operation buttons that allow the user to input operation commands, such as a document read command or an image forming command.

The entire body of the document reading section 1A is supported by a support frame 15.

The image forming section 1B includes a sheet output tray 21 onto which sheets having images formed at the upper sides thereof are ejected. The image forming section 1B also includes a front cover 22 at the front side thereof. The front cover 22 is opened when a part such as a toner container is to be replaced or when a sheet jammed during transportation is to be removed. Three drawer-type sheet feed trays 23_1, 23_2, and 23_3 are housed below the front cover 22, and sheets on which images are not yet formed are stacked on the sheet feed trays 23_1, 23_2, and 23_3.

The image forming section 1B also includes a side cover 24 at the left side thereof. The side cover 24 is opened when a sheet jammed during transportation is to be removed.

The image forming section 1B is provided with wheels 251, which make the image forming section 1B movable, on the bottom surface thereof.

Figure 2:
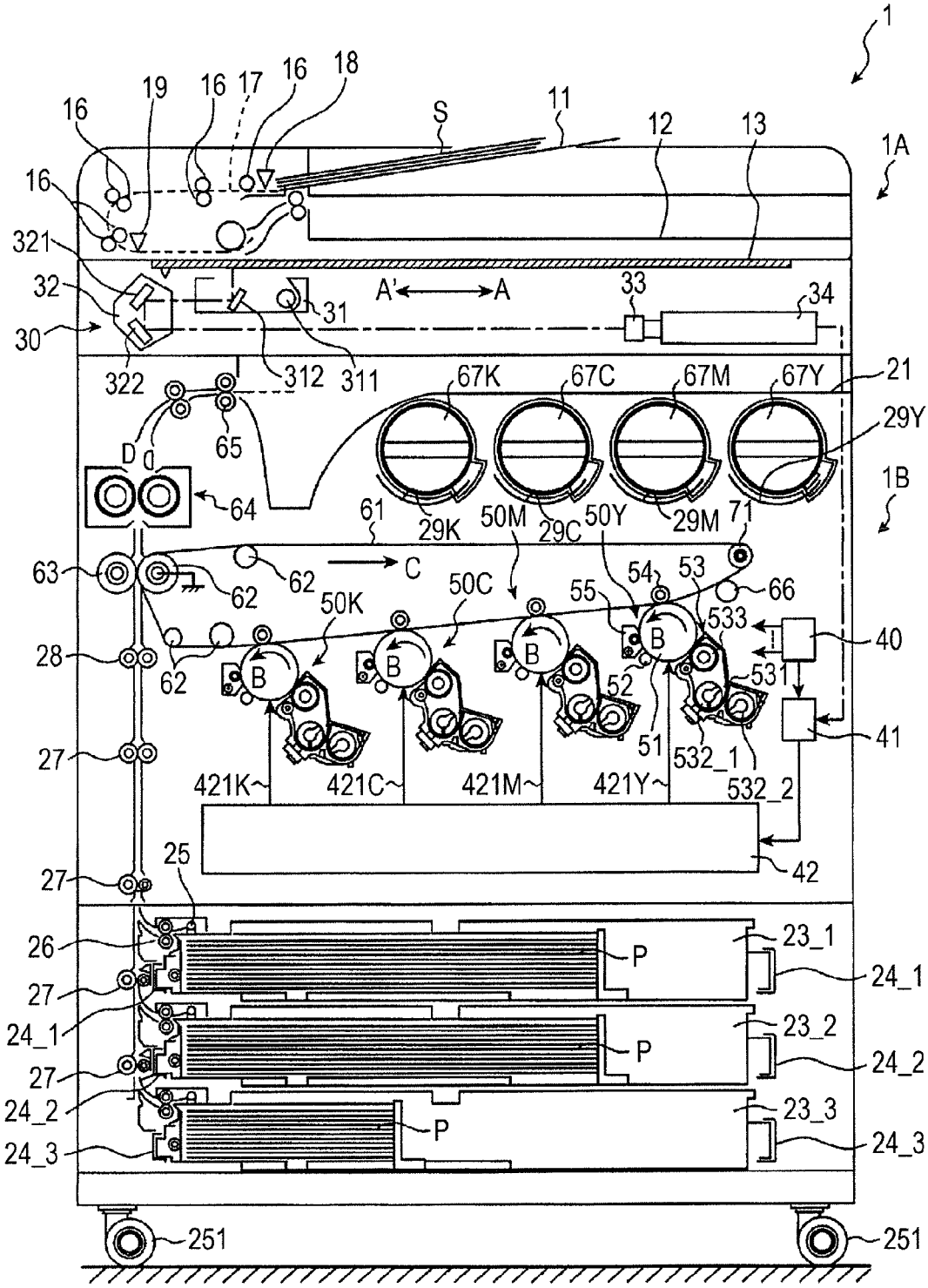
FIG. 2 illustrates the inner structure of the copier illustrated in FIG. 1.

FIG. 2 illustrates the inner structure of the copier 1 illustrated in FIG. 1.

A document-reading optical system 30 is installed below the document reading plate 13 made of transparent glass. The document reading optical system 30 includes a first block 31, a second block 32, and a photoelectric sensor 33. The first block 31 includes a lamp 311 and a mirror 312. The second block 32 includes two mirrors 321 and 322. The photoelectric sensor 33 reads light representing an image and generates an image signal.

The first block 31 and the second block 32 are movable along the document reading plate 13 in the direction of arrow A-A', and are at left positions illustrated in FIG. 2 in an initial state.

Document sheets S placed on the document feed tray 11 are fed one by one and transported by transport rollers 16 along a transport path 17 that is in contact with the document reading plate 13. The lamp 311 radiates each document sheet S with light when the document sheet S is transported while being in contact with the document reading plate 13. The light reflected by the document sheet S is reflected by the mirrors 312, 321, and 322, and is read by the photoelectric sensor 33. The photoelectric sensor 33 generates image signals representing characters or images recorded on the document sheet S. After being radiated by the lamp 311, the document sheet S is further transported and ejected onto the document output tray 12.

When a document sheet is placed on the document reading plate 13, the first block 31 and the second block 32 move in the direction of arrow A so that the optical distance between a reading position of the document sheet on the document reading plate 13 and the photoelectric sensor 33 is maintained constant. During the movement, the lamp 311 radiates the document sheet with light, and the photoelectric sensor 33 reads characters or images on the document sheet and converts the characters or images into image signals.

The image signals generated by the photoelectric sensor 33 are input to an image processor 34. The photoelectric sensor 33 generates RGB image signals including red (R), green (G), and blue (B) image signals. The image processor 34 converts the RGB image signals into YMCK image data of four colors, which are yellow (Y), magenta (M), cyan (C), and black (K), and temporarily stores the image data. The YMCK image data is transmitted to an exposure controller 41 in accordance with the timing of an exposure process for forming a latent image, which will be described below.

The image forming section 1B includes an exposure unit 42, which receives the YMCK image data from the exposure controller 41 in a latent-image forming operation. The exposure unit 42 emits exposure light beams 421Y, 421M, 421C, and 421K that are modulated in accordance with the YMCK image data.

FIG. 2 also illustrates a control unit 40 at a position next to the exposure controller 41. The control unit 40 includes a microcomputer and a program executed by the microcomputer. The control unit 40 is connected to the exposure controller 41, the display operation unit 14 (see FIG. 1), the image processor 34, and other components such as power supply circuits and driving circuits (not shown), and controls the overall operation of the copier 1.

The above-described three sheet feed trays 23_1, 23_2, and 23_3 are supported by left and right guide rails 24_1, 24_2, and 24_3 in a lower area of the image forming section 1B. Each of the sheet feed trays 23_1, 23_2, and 23_3 holds sheets P in a stacked state. The sheet feed trays 23_1, 23_2, and 23_3 may be pulled out while being guided by the guide rails 24_1, 24_2, and 24_3, respectively, so that new sheets P may be placed thereon.

One of the three sheet feed trays 23_1, 23_2, and 23_3 is designated by, for example, an operation of the display operation unit 14 (see FIG. 1). Here, it is assumed that the sheet feed tray 23_1 is designated. The sheets P on the designated sheet feed tray 23_1 are fed by a pickup roller 25 and are separated from each other by separation rollers 26. Then, each sheet P is transported upward by transport rollers 27, and is further transported upward after the timing of transportation is adjusted by a standby roller 28. The manner in which the sheet is transported beyond the standby roller 28 will be described below.

Four image forming units 50Y, 50M, 50C, and 50K that form toner images with toners of respective colors, which are Y, M, C, and K, are arranged in a central area of the image forming section 1B. The four image forming units 50Y, 50M, 50C, and 50K have the same structure except for the color of toner used therein. Here, the structure of the image forming unit 50Y will be representatively described.

The image forming unit 50Y includes a photoconductor 51 that rotates in the direction of arrow B in FIG. 2. A charging device 52, a developing device 53, and a cleaner 55 are arranged around the photoconductor 51. A transfer member 54 is arranged so that an intermediate transfer belt 61, which will be described below, is placed between the transfer member 54 and the photoconductor 51.

The photoconductor 51, which is roll-shaped, becomes charged with electricity in a charging process and releases the electric charges in the exposure process so that an electrostatic latent image is formed on the surface thereof.

The charging device 52 charges the surface of the photoconductor 51 to a certain charge potential.

The image forming section 1B includes the exposure unit 42 described above. The exposure unit 42 receives the image signals from the exposure controller 41, and emits the exposure light beams 421Y, 421M, 421C, and 421K that are modulated in accordance with the received image signals. The photoconductor 51 included in the image forming unit 50Y is charged by the charging device 52, and is then radiated with the exposure light beam 421Y from the exposure unit 42. Thus, an electrostatic latent image is formed on the surface of the photoconductor 51.

The developing device 53 develops the electrostatic latent image that has been formed on the surface of the photoconductor 51 as a result of the radiation with the exposure light beam 421Y. Thus, a toner image, that is, a yellow (Y) toner image in the image forming unit 50Y, is formed on the surface of the photoconductor 51.

The developing device 53 includes a casing 531 that contains developer formed of toner and carrier; two augers 532_1 and 532_2 that stir the developer; and a developing roller 533 that carries the developer to the position where the developing roller 533 faces the photoconductor 51. The augers 532_1 and 532_2 and the developing roller 533 are arranged in the casing 531. To develop the electrostatic latent image formed on the photoconductor 51, a bias voltage is applied to the developing roller 533. The bias voltage causes the toner in the developer to adhere to the photoconductor 51 in areas where the electrostatic latent image is formed on the photoconductor 51. As a result, a toner image is formed.

The toner image formed on the photoconductor 51 by the developing process performed by the developing device 53 is transferred onto the intermediate transfer belt 61 by the transfer member 54.

The cleaner 55 removes the toner that remains on the photoconductor 51 after the transfer process.

The intermediate transfer belt 61 is an endless belt that is wound around plural rollers 62 and that rotates in the direction of arrow C.

The toner images of respective colors formed by the image forming units 50Y, 50M, 50C, and 50K are successively transferred onto the intermediate transfer belt 61 in a superimposed manner, and are transported to a second transfer position where a transfer device 63 is disposed. In synchronization with this, the sheet that has been transported to the standby roller 28 is transported to the second transfer position, where the transfer device 63 transfers the toner images on the intermediate transfer belt 61 onto the transported sheet. The sheet onto which the toner images have been transferred is further transported to a fixing device 64, which fixes the toner images to the sheet by applying heat and pressure. As a result, an image formed of the fixed toner images is recorded on the sheet. The sheet having the image formed thereon is further transported to a sheet output roller 65, which ejects the sheet onto the sheet output tray 21.

After the transfer device 63 transfers the toner images onto the sheet, the intermediate transfer belt 61 further rotates so that residual toner on the surface of the intermediate transfer belt 61 is removed therefrom by a cleaner 66.

Container support members 29Y, 29M, 29C, and 29K are disposed above the intermediate transfer belt 61 in the image forming section 1B. Toner containers 67Y, 67M, 67C, and 67K that respectively contain yellow (Y), magenta (M), cyan (C), and black (K) toners are attached to the container support members 29Y, 29M, 29C, and 29K, respectively. An operator may attach the toner containers 67Y, 67M, 67C, and 67K to the container support members 29Y, 29M, 29C, and 29K by sliding the toner containers 67Y, 67M, 67C, and 67K in an attachment direction (from front to back along the direction perpendicular to the plane of FIG. 2). The operator may remove the toner containers 67Y, 67M, 67C, and 67K from the container support members 29Y, 29M, 29C, and 29K by sliding the toner containers 67Y, 67M, 67C, and 67K in a direction opposite to the attachment direction. The toner containers 67Y, 67M, 67C, and 67K attached to the container support members 29Y, 29M, 29C, and 29K supply the toners of the respective colors contained in the toner containers 67Y, 67M, 67C, and 67K to the corresponding developing devices 53. The toners are supplied to the developing device 53 in accordance with the amounts of toner consumption thereof through toner supply units 73 (see FIG. 3) that are provided for the respective developing devices 53.

Figure 3:
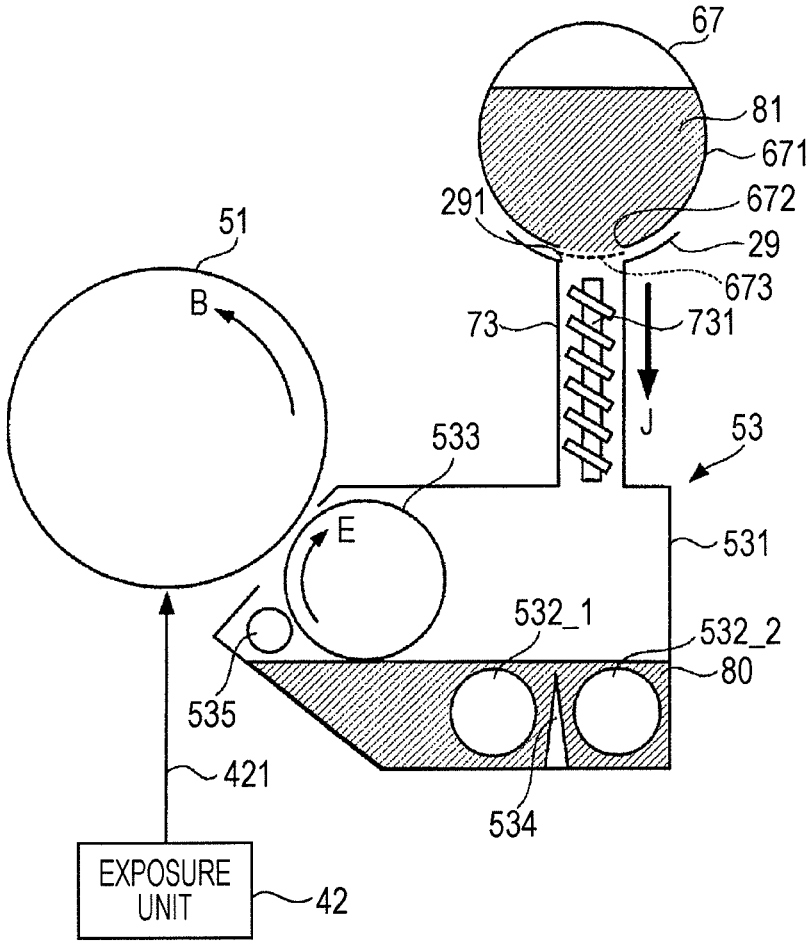
FIG. 3 illustrates a toner supply path from a toner container to a developing device.

FIG. 3 illustrates a toner supply path from each toner container to the corresponding developing device 53.

In FIG. 3 and the following figures, components having the same structure irrespective of the colors of toners used are denoted by reference numerals without the characters Y, M, C, and K for distinguishing the color. For example, the toner container is denoted by reference numeral 67.

FIG. 3 illustrates the photoconductor 51, the exposure unit 42, the developing device 53, the toner container 67, the container support member 29, and the toner supply unit 73. As described above, the developing device 53 includes the casing 531, the two augers 532_1 and 532_2, and the developing roller 533. FIG. 3 also illustrates developer 80 contained in the casing 531, a separation wall 534, and a layer-thickness regulator 535. The separation wall 534 is disposed in a chamber that houses the two augers 532_1 and 532_2 and extends through a central area of the chamber excluding both ends thereof in a direction perpendicular to the plane of FIG. 3. The layer-thickness regulator 535 regulates the thickness of a developer layer on the developing roller 533.

The charging device 52 (see FIG. 2) charges the photoconductor 51 and the exposure unit 42 radiates the photoconductor 51 with the exposure light beam 421 while the photoconductor 51 rotates in the direction of arrow B. Thus, an electrostatic latent image is formed on the surface of the photoconductor 51. Then, the developing device 53 performs the developing process to form a toner image on the surface of the photoconductor 51.

The developer 80 contained in the casing 531 of the developing device 53 includes toner and carrier, and is stirred by the two augers 532_1 and 532_2 while being circulated in the direction perpendicular to the page of FIG. 3.

The developer 80 in the casing 531 adheres to the surface of the developing roller 533, which rotates in the direction of arrow E, and is transported to the position where the developing roller 533 faces the photoconductor 51 after the thickness of the developer layer is regulated by the layer-thickness regulator 535. At this position, the toner included in the developer adheres to the surface of the photoconductor 51 in areas where the electrostatic latent image is formed on the surface of the photoconductor 51. As a result, the toner image is formed on the photoconductor 51. The developer on the developing roller 533 is further transported as the developing roller 533 rotates, removed from the developing roller 533 in the casing 531, and stirred by the augers 532_1 and 532_2. Thus, the toner included in the developer 80 in the casing 531 is consumed to develop the electrostatic latent image on the photoconductor 51. Accordingly, the proportion of the carrier in the developer 80 in the casing 531 increases.

To compensate for the reduction in the amount of toner in the casing 531 of the developing device 53, toner 81 in the toner container 67 that is supported on the container support member 29 is supplied to the developing device 53. To supply the toner 81 to the developing device 53, a toner transport member 731, which is disposed in the toner supply unit 73, rotates in accordance with the consumption of the toner in the developing device 53. Thus, the toner transport member 731 transports the toner through the toner supply unit 73 in the direction of arrow J and supplies the toner to the casing 531 of the developing device 53. The toner that has been supplied from the toner container 67 to the developing device 53 through the toner supply unit 73 is stirred together with the developer 80 in the casing 531 of the developing device 53 by the augers 532_1 and 532_2.

The toner container 67 includes a container housing 671 that contains the toner 81. The container housing 671 has a container opening 672 in a bottom surface thereof when the toner container 67 is supported by the container support member 29 from below. The toner 81 contained in the toner container 67 is transported to the toner supply unit 73 through the container opening 672. The toner container 67 also includes a shutter member 673 that closes the container opening 672. The operator may attach the toner container 67 onto the container support member 29 by sliding the toner container 67 along the container support member 29 in the attachment direction, that is, in the direction perpendicular to the plane of FIG. 2 from the front side of FIG. 2. The operator may remove the toner container 67 from the container support member 29 by sliding the toner container 67 in the detachment direction, which is the direction opposite to the attachment direction. The shutter member 673 provided on the toner container 67 is slidable between a closed position for closing the container opening 672 and an open position for opening the container opening 672. The shutter member 673 is at the closed position when the toner container 67 is not attached to the container support member 29. When the toner container 67 is slid in the attachment direction and attached to the container support member 29, the shutter member 673 moves from the closed position to the open position in response to the sliding movement of the toner container 67 in the attachment direction. When the toner container 67 that is attached to the container support member 29 is slid in the detachment direction, the shutter member 673 slides from the open position to the closed position in response to the sliding movement of the toner container 67.

The container support member 29 has a support-member opening 291 that opens upward. The support-member opening 291 is positioned so as to communicate with the container opening 672 when the toner container 67 is attached to the container support member 29. The support-member opening 291 serves as an inlet of the toner supply unit 73. The toner 81 is discharged from the toner container 67 in the attached state through the container opening 672, and is caused to enter the toner supply unit 73 through the support-member opening 291. Thus, the toner 81 in the toner container 67 is caused to enter the toner supply unit 73 through the container opening 672 and the support-member opening 291.

As described above, the toner transport member 731 in the toner supply unit 73 rotates in accordance with the consumption of the toner in the developing device 53 to supply the amount of toner that corresponds to the amount of consumption thereof to the developing device 53.

Figure 4A:
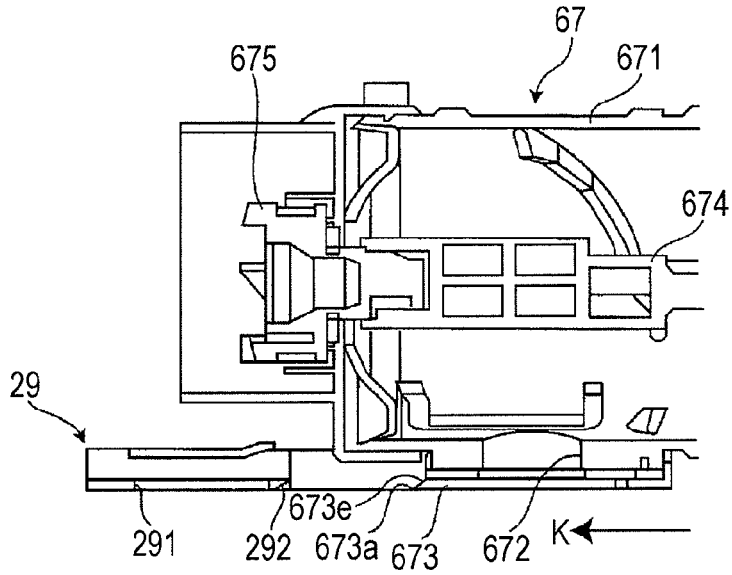
FIGS. 4A and 4B illustrate the state in which the toner container has been slid along a container support member in an attachment direction and a container opening in the toner container has approached a support-member opening in the container support member.
Figure 4B:
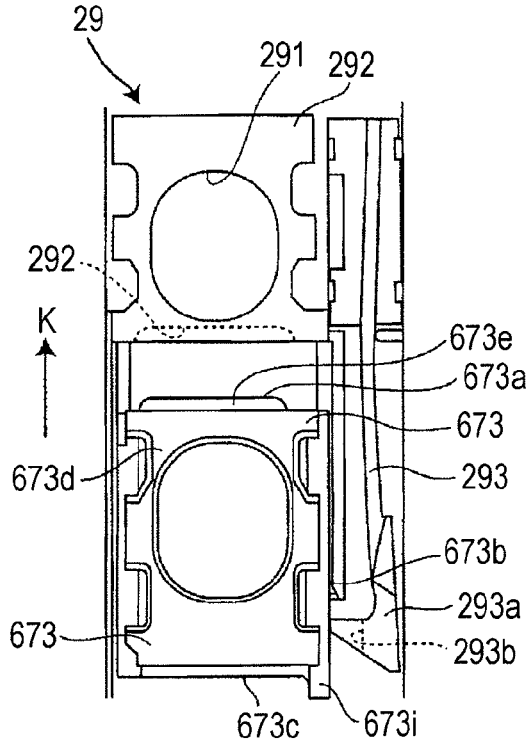

FIGS. 4A and 4B illustrate the state in which the toner container 67 has been slid along the container support member 29 in the attachment direction and the container opening 672 in the toner container 67 has approached the support-member opening 291 in the container support member 29. FIG. 4A is a sectional view of the toner container 67 in an area around the container opening 672. FIG. 4B is a plan view, viewed from the top (from the toner-container side), illustrating the state in which parts of the toner container 67 other than the shutter member 673 are removed.

Figure 5A:
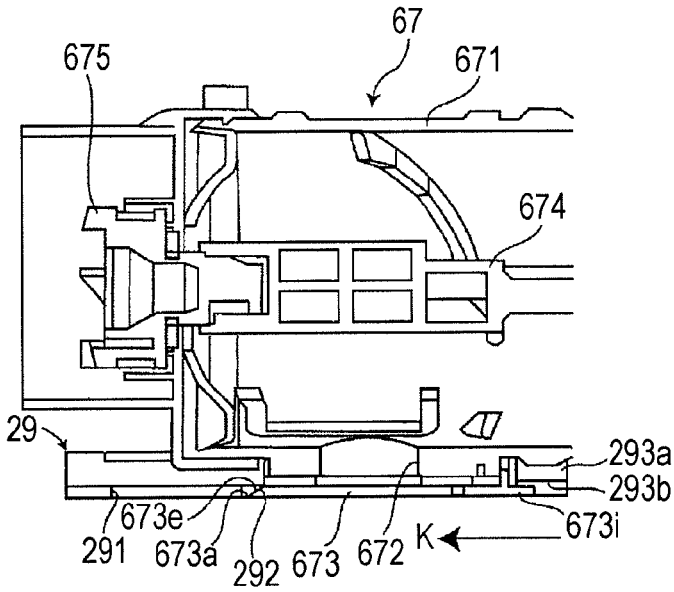
FIGS. 5A and 5B are diagrams similar to FIGS. 4A and 4B, respectively, illustrating the state in which the toner container has been moved further in the attachment direction from the state illustrated in FIGS. 4A and 4B.
Figure 5B:
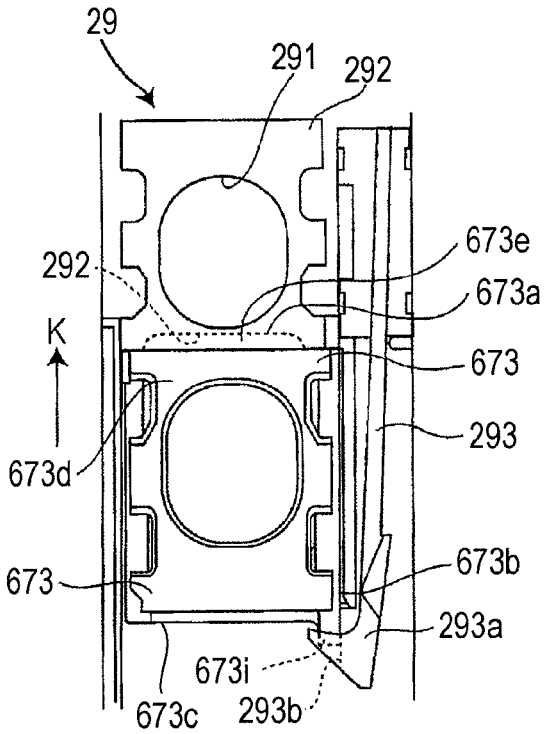

FIGS. 5A and 5B are diagrams similar to FIGS. 4A and 4B, respectively, illustrating the state in which the toner container 67 has been moved further in the attachment direction from the state illustrated in FIGS. 4A and 4B.

Figure 6:
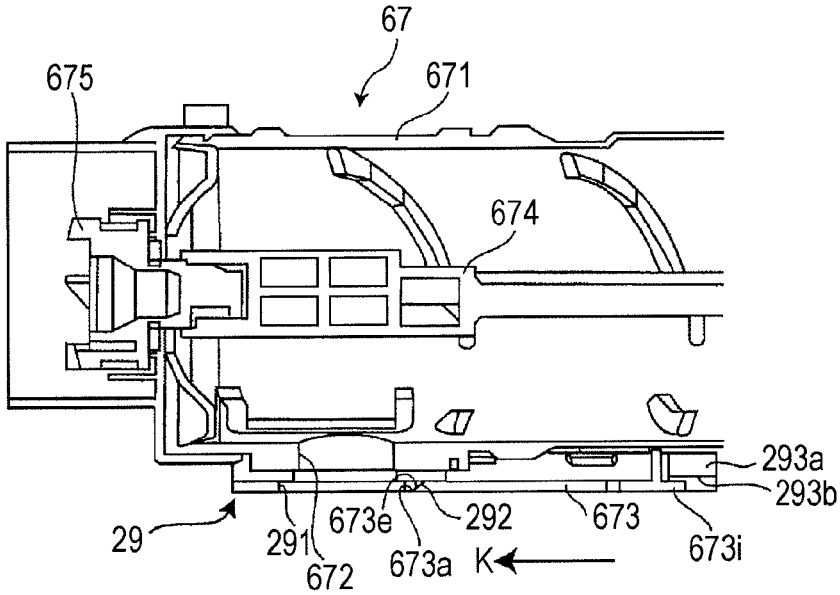
FIG. 6 is a diagram similar to FIG. 4A, illustrating the final state in which the toner container has been moved further in the attachment direction from the state illustrated in FIGS. 5A and 5B and is attached to the container support member.

FIG. 6 is a diagram similar to FIG. 4A, illustrating the final state in which the toner container 67 has been moved further in the attachment direction from the state illustrated in FIGS. 5A and 5B and is attached to the container support member 29.

Figure 7:
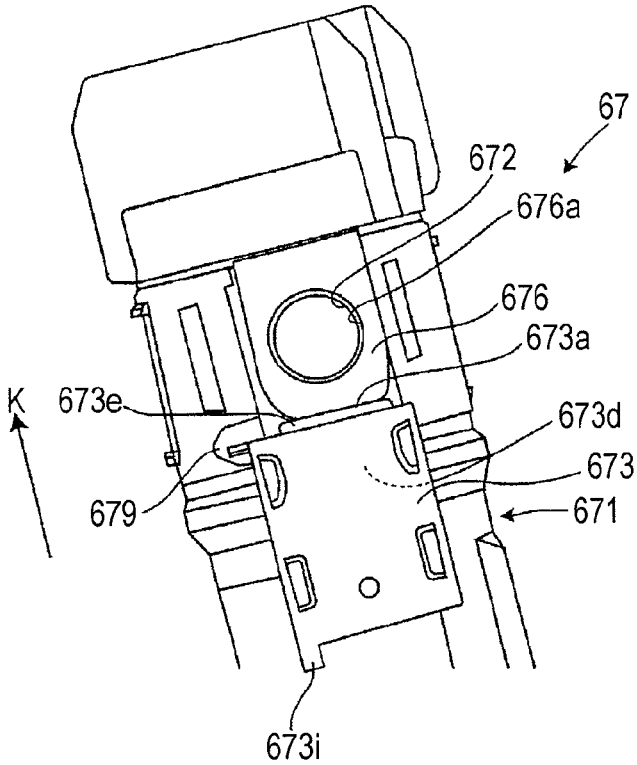
FIG. 7 is a plan view, viewed from below (from the container-support-member side), of the toner container in the final state illustrated in FIG. 6.

FIG. 7 is a plan view, viewed from below (from the container-support-member side), of the toner container in the final state illustrated in FIG. 6.

As illustrated in FIG. 4A, a stirring member 674 that rotates to stir the toner (not shown) contained in the container housing 671 is disposed in the container housing 671 of the toner container 67. The stirring member 674 is rotated by a rotational driving force transmitted from the image forming section 1B (see FIGS. 1 and 2) through a coupling member 675 provided at an end of the stirring member 674. Thus, the stirring member 674 transports the toner to the container opening 672 while stirring the toner.

The support-member opening 291 in the container support member 29 is illustrated at the lower left position in FIG. 4A. The arrow K in FIG. 4A indicates the attachment direction. The container support member 29 includes an abutting portion 292. Referring to FIGS. 5A and 5B, the abutting portion 292 is a wall portion that receives a front end 673*a* of the shutter member 673 in the attachment direction when the toner container 67 slides in the attachment direction (direction of arrow K) and the shutter member 673 approaches the support-member opening 291. The abutting portion 292 receives the front end 673*a* of the shutter member 673 in the attachment direction and stops the shutter member 673 from sliding further in the attachment direction. Therefore, when the container housing 671 of the toner container 67 is further slid in the attachment direction, the abutting portion 292 slides the shutter member 673 relative to the container housing 671 from the closed position for closing the container opening 672 (see FIGS. 4A and 5A) to the open position for opening the container opening 672 (see FIG. 6).

The container support member 29 also includes a cantilever-shaped retaining portion 293 (see FIG. 4B). The retaining portion 293 is positioned so as to interfere with a side surface 673*b* of the shutter member 673 when the toner container 67 is moved in the attachment direction (direction of arrow K). When the toner container 67 is slid in the attachment direction (direction of arrow K), an end portion 293*a* of the retaining portion 293 interferes with the shutter member 673 and is pushed so that the retaining portion 293 is elastically bent, as illustrated in FIG. 4B. Then, the toner container 67 is further moved in the attachment direction while the end portion 293*a* of the retaining portion 293 scratches the side surface 673*b* of the shutter member 673. When the shutter member 673 reaches a position immediately in front of the position where the front end 673*a* of the shutter member 673 is abutted against the abutting portion 292, the retaining portion 293 is released from the interference with the shutter member 673.

Accordingly, as illustrated in FIG. 5B, the end portion 293*a* of the retaining portion 293 is moved to a back end 673*c* of the shutter member 673, so that the shutter member 673 is prevented from sliding in the detachment direction (direction opposite to the direction of arrow K).

In the process of attaching the toner container 67 to the container support member 29, the front end 673*a* of the shutter member 673 is abutted against the abutting portion 292. Subsequently, the toner container 67 is further slid in the attachment direction (direction of arrow K) until the state illustrated in FIGS. 6 and 7 is established. More specifically, the toner container 67 is slid in the attachment direction (direction of arrow K) while the front end 673*a* of the shutter member 673 is abutted against the abutting portion 292. As a result, the shutter member 673 slides relative to the container housing 671 in the direction opposite to the direction of arrow K, and moves to the open position for opening the container opening 672 (position illustrated in FIGS. 6 and 7). The attaching process is completed when the container opening 672 reaches the position where the container opening 672 communicates with the support-member opening 291.

As illustrated in FIG. 7, the toner container 67 includes a sealing member 676. The sealing member 676 has a hole 676*a* that communicates with the container opening 672, and is attached to the container housing 671 so as to surround the container opening 672. The shutter member 673 slides relative to the container housing 671 between the closed position for closing the container opening 672 and the open position, which is illustrated in FIG. 7, for opening the container opening 672. At this time, the shutter member 673 slides along the sealing member 676.

Thus, in the present exemplary embodiment, the sealing member 676 is provided so as to surround the container opening 672. When the shutter member 673 is at the closed position, the sealing member 676 is interposed between a portion of the container housing 671 around the container opening 672 and the shutter member 673, so that toner leakage may be prevented. When the shutter member 673 is at the open position, as illustrated in FIG. 6, the sealing member 676 is interposed between the portion of the container housing 671 around the container opening 672 and a portion of the container support member 29 around the support-member opening 291. Thus, the toner discharged from the container opening 672 is prevented from leaking to the outside instead of passing through the support-member opening 291.

Referring to FIG. 7, the front end 673*a* of the shutter member 673 overlaps with the sealing member 676 even when the shutter member 673 is at the open position. The configuration in which the shutter member 673 partially overlaps with the sealing member 676 even at the open position reduces the risk that the shutter member 673 will come into contact with the sealing member 676 and roll the sealing member 676 or the risk that the shutter member 673 cannot be moved to the closed position when the shutter member 673 is slid from the open position toward the closed position.

To remove the toner container 67 from the container support member 29, the toner container 67 is slid in the detachment direction that is opposite to the attachment direction (direction of arrow K). As illustrated in FIG. 5B, the back end 673*c* of the shutter member 673 in the attachment direction, that is, the front end in the detachment direction, is retained by the retaining portion 293 and cannot be moved in the detachment direction. Therefore, when the container housing 671 is slid in the detachment direction, the shutter member 673 slides relative to the container housing 671 from the open position illustrated in FIG. 5 to the closed position for closing the container opening 672. When the shutter member 673 reaches the closed position, a releasing rib 679 (see FIG. 7) provided on the container housing 671 pushes the retaining portion 293 (see FIG. 5B) outward. As a result, the shutter member 673 is released from the retaining portion 293, and the entire body of the toner container 67 including the container housing 671 and the shutter member 673 is detached from the container support member 29 while the shutter member 673 is at the closed position for closing the container opening 672.

The shutter member 673 has an inclined surface 673*e* at the front end portion, in the attachment direction, of a surface 673*d* that faces the container opening 672. The inclined surface 673*e* is inclined such that the distance from the container opening 672 increases toward the front end 673*a* in the attachment direction.

The abutting portion 292 has an inclined surface that comes into surface contact with the inclined surface 673*e* of the shutter member 673 when the front end 673*a* of the shutter member 673 is abutted against the abutting portion 292.

As illustrated in FIG. 4B, the shutter member 673 includes a projecting portion 673*i* at the back end 673*c* thereof in the attachment direction (direction of arrow K). The projecting portion 673*i* projects backward in the attachment direction at a corner of the shutter member 673 that is adjacent to the retaining portion 293. The end portion 293*a* of the retaining portion 293 has a step part 293*b* that is recessed in a step shape at a position corresponding to the projecting portion 673*i* of the shutter member 673.

When the toner container 67 is in the attached state, as illustrated in FIG. 6, the inclined surface 673*e* at the front end portion of the shutter member 673 is in contact with the abutting portion 292 that has the inclined surface. In addition, the step part 293*b* of the end portion 293*a* of the retaining portion 293 is placed on the projecting portion 673*i* at the back end 673*c* of the shutter member 673.

The above-described exemplary embodiment is hereinafter referred to as a first exemplary embodiment. Now, the interaction between the shutter member 673 and the abutting portion 292 and the interaction between the shutter member 673 and the retaining portion 293 will be described in detail.

Figure 8:
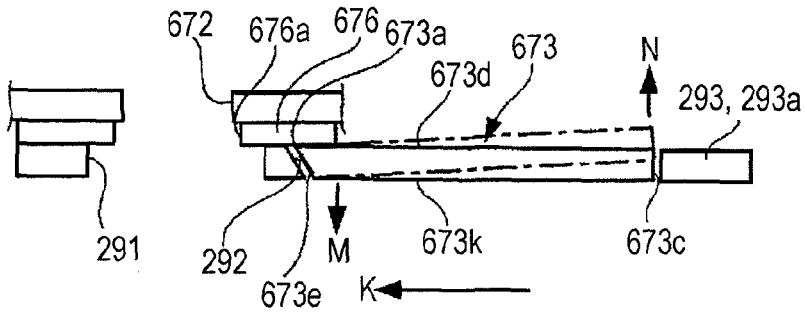
FIG. 8 RELATED ART
FIG. 8 is a schematic sectional view illustrating a support-member opening and a container opening in an overlapped state and a shutter member according to a comparative example.

FIG. 8 is a schematic sectional view illustrating a support-member opening and a container opening in an overlapped state and a shutter member according to a comparative example.

In the following description, to facilitate understanding, components of the same concept are denoted by the same reference numeral irrespective of whether the components are of a comparative example or an exemplary embodiment, even when the components have different shapes. For example, shutter members are denoted by 673.

In the above-described first exemplary embodiment, the shutter member 673 (see, for example, FIG. 6 and FIG. 12, which will be described below) has the inclined surface 673*e* at the front end portion thereof in the attachment direction. The inclined surface 673*e* is formed at the surface 673*d* that faces the container opening 672 and is inclined such that the distance from the container opening 672 increases toward the front end 673*a* in the attachment direction. In contrast, although the shutter member 673 according to the comparative example illustrated in FIG. 8 includes an inclined surface 673*e* at the front end portion thereof, the inclined surface 673*e* is not formed at a surface 673*d* that faces a container opening 672 but is formed at a back surface 673*k*, which is at the side opposite to the surface 673*d*. Accordingly, an abutting portion 292 has an inclined surface that is inclined in a direction opposite to the direction in which the abutting portion 292 according to the first exemplary embodiment (see, for example, FIGS. 6 and 12) is inclined.

In general, the shutter member 673 is attached to the container housing 671 of the toner container 67 with a certain clearance therebetween. When the operator slides the toner container 67 along the container support member 29 in the attachment direction or the detachment direction, the operability of the toner container 67 would be very low if the posture of the toner container 67 relative to the container support member 29 is severely limited. Therefore, to increase the operability of the toner container 67, clearances are provided to allow the toner container 67 to be received even if the toner container 67 is slid while being somewhat inclined relative to the container support member 29. For this purpose, the shutter member 673 also has a clearance.

When the shutter member 673 is at the closed position, the sealing member 676 is interposed between the portion of the container housing 671 around the container opening 672 and the shutter member 673, so that the toner is prevented from leaking through the container opening 672. Therefore, the sealing member 676 is compressed in the vertical direction, that is, in the direction in which the sealing member 676 is clamped between the container housing 671 and the shutter member 673. In addition, to allow the shutter member 673 to smoothly slide from the open position to the closed position, the front end portion of the shutter member 673 in the attachment direction (direction of arrow K) overlaps with the sealing member 676 when the shutter member 673 is at the open position. Therefore, when the shutter member 673 is at the open position, the front end portion of the shutter member 673 that overlaps with the sealing member 676 is pressed downward, that is, in the direction of arrow M in FIG. 8, by the sealing member 676 that is compressed by the front end portion of the shutter member 673.

If no countermeasure is taken against the downward pressure applied to the front end portion, owing to the above-described clearances, the back end portion of the shutter member 673 rotates upward in the direction of arrow N in FIG. 8. As a result, the shutter member 673 moves to the position shown by one-dot chain lines in FIG. 8.

As described above, there is a clearance between the toner container 67 and the container support member 29. Therefore, depending on the posture of the toner container 67 in the process of detaching the toner container 67 from the container support member 29, there is a risk that the back end 673*c* of the shutter member 673, which is to be retained by the retaining portion 293, will be accidentally released therefrom before the shutter member 673 reaches the closed position and closes the container opening 672. In such a case, the toner container 67 will be pulled out while the container opening 672 is not completely closed by the shutter member 673 and toner contamination will occur.

In the comparative example illustrated in FIG. 8, the inclined surface 673*e* at the front end portion of the shutter member 673 comes into surface contact with the inclined surface of the abutting portion 292. Therefore, it may seem that the abutting portion 292 will interfere with the inclined surface 673*e* of the shutter member 673 to prevent the rotation of the shutter member 673 even when the front end portion of the shutter member 673 is pressed by the sealing member 676 in the direction of arrow M. However, although the shutter member 673 is disposed between the abutting portion 292 and the retaining portion 293 in the front-back direction, there is a clearance between the back end 673*c* of the shutter member 673 and the retaining portion 293 when the inclined surface 673*e* is abutted against the abutting portion 292. Therefore, when the toner container 67 starts to slide in the detachment direction (direction opposite to the direction of arrow K), the shutter member 673 moves together with the container housing 671 in the detachment direction in the initial stage of the sliding movement until the back end 673*c* comes into contact with the retaining portion 293. As a result, in the initial stage of the sliding movement in the detachment direction, the shutter member 673 moves away from the abutting portion 292. When the shutter member 673 receives the force in the direction of arrow M from the sealing member 676 in this stage, the shutter member 673 tends to move to the position shown by the one-dot chain lines in FIG. 8. As described above, to ensure the operability of the toner container 67, the toner container 67 is configured to be movable while the posture thereof relative to the container support member 29 is not severely limited. Since the shutter member 673 may be at the position shown by the one-dot chain lines in FIG. 8, depending on the posture of the toner container 67 during the sliding movement thereof in the detachment direction, there is a risk that the back end 673*c* of the shutter member 673 will be released from the retaining portion 293 instead of abutting against the shutter member 673 as intended. If the back end 673*c* of the shutter member 673 is released from the retaining portion 293, the toner container 67 may be pulled out while the container opening 672 is not appropriately closed by the shutter member 673 when the toner container 67 is further slid in the detachment direction. In such a case, the toner that remains in the toner container 67 may leak through the container opening 672 and contaminate the apparatus or stain the operator's clothes.

Figure 9:
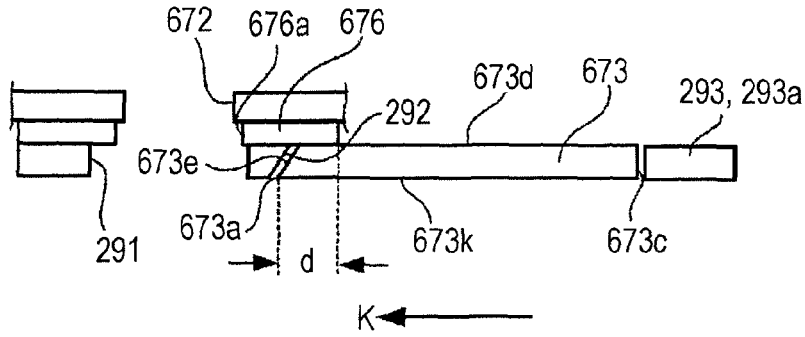
FIG. 9 is a diagram similar to FIG. 8 that illustrates the comparative example, illustrating a second exemplary embodiment in which the shutter member has a characteristic front end portion.

FIG. 9 is a diagram similar to FIG. 8 that illustrates the comparative example, illustrating a second exemplary embodiment which differs from the first exemplary embodiment but in which the shutter member 673 has a characteristic front end portion.

In the second exemplary embodiment illustrated in FIG. 9, the shutter member 673 has an inclined surface 673*e*, which is similar to that in the above-described first exemplary embodiment (see, for example, FIGS. 6 and 12), at the front end portion thereof in the attachment direction (direction of arrow K). In other words, according to the second exemplary embodiment, the inclined surface 673*e* is provided at the front end portion of the shutter member 673 in the attachment direction at the surface 673*d* that is in contact with the sealing member 676. The inclined surface 673*e* is inclined such that the distance from the container opening 672 increases toward the front end 673*a* in the attachment direction (direction of arrow K). Accordingly, the abutting portion 292 has an inclined surface that is shaped such that the abutting portion 292 may be fitted in a gap between the inclined surface 673*e* of the shutter member 673 and the sealing member 676. Compared with the comparative example illustrated in FIG. 8, the shutter member 673 overlaps with the sealing member 676 over a longer distance d from the front end 673*a*. Accordingly, compared with the comparative example illustrated in FIG. 8, the point of application of the pressing force applied by the sealing member 676 is closer to the back end 673*c* of the shutter member 673. Therefore, even when the same force as that in the comparative example illustrated in FIG. 8 is applied by the sealing member 676, the back end 673*c* of the shutter member 673 is not easily raised to the position illustrated by one-dot chain lines in FIG. 8. Therefore, when the toner container 67 is slid in the detachment direction, the back end 673*c* of the shutter member 673 comes into contact with the retaining portion 293 and the shutter member 673 reliably slides to the closed position for closing the container opening 672.

Figure 10:
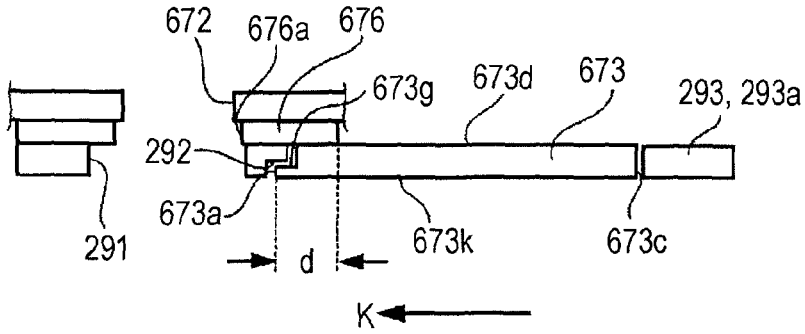
FIG. 10 is a diagram similar to FIGS. 8 and 9, illustrating a third exemplary embodiment in which the shutter member has a characteristic front end portion.

FIG. 10 is a diagram similar to FIGS. 8 and 9, illustrating a third exemplary embodiment in which the shutter member 673 has a characteristic front end portion.

In the third exemplary embodiment illustrated in FIG. 10, the shutter member 673 includes a step part 673*g* at the front end portion thereof in the attachment direction (direction of arrow K). The step part 673*g* is formed in the surface 673*d* that is in contact with the sealing member 676 and is step-shaped so as to be separate from the sealing member 676. Accordingly, the abutting portion 292 is step-shaped so that the abutting portion 292 may be fitted in a gap between the step part 673*g* of the shutter member 673 that is separate from the sealing member 676 and the sealing member 676. Similar to the inclined structure illustrated in FIG. 9, also in this stepped structure, the point of application of the pressing force applied by the sealing member 676 may be shifted toward the back end 673*c* of the shutter member 673. As a result, the amount by which the back end 673*c* of the shutter member 673 is raised may be reduced or eliminated. Therefore, the shutter member 673 may be reliably moved to the closed position in the process of detaching the toner container 67.

Figure 11:
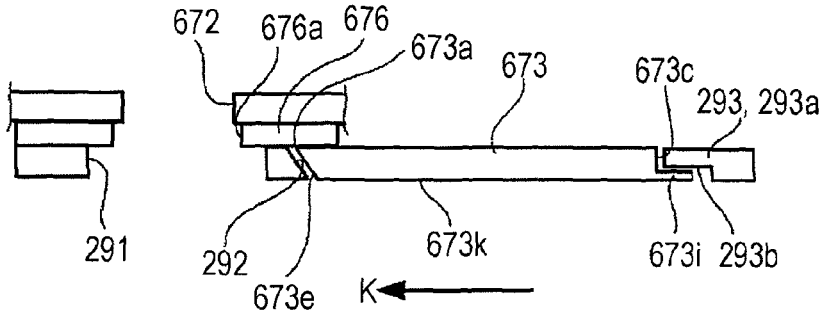
FIG. 11 is a diagram similar to FIGS. 8 to 10, illustrating a fourth exemplary embodiment in which the shutter member has a characteristic back end portion.

FIG. 11 is a diagram similar to FIGS. 8 to 10, illustrating a fourth exemplary embodiment in which the shutter member 673 has a characteristic back end portion.

In the fourth exemplary embodiment illustrated in FIG. 11, the shutter member 673 includes a projecting portion 673*i* that projects backward at a back end 673*c* thereof. The projecting portion 673*i* is provided only at the retaining-lug-293 side, similar to the projecting portion 673*i* according to the above-described first exemplary embodiment (see FIG. 4A). In that regard, the sectional view of FIG. 11 is not exactly correct; FIG. 11 schematically illustrates the projecting portion 673*i* to facilitate understanding. The same applies to the following figures.

The retaining portion 293 has a step part 293*b* that is recessed in a step shape at a position corresponding to the projecting portion 673*i*. When the shutter member 673 is at the open position, the step part 293*b* of the retaining portion 293 is placed on the projecting portion 673*i* of the shutter member 673. Therefore, even when the front end portion of the shutter member 673 receives a force from the sealing member 676, the back end 673*c* of the shutter member 673 is suppressed from being raised. As a result, the shutter member 673 may be reliably moved to the closed position for closing the container opening 672 in the process of detaching the toner container 67.

Figure 12:
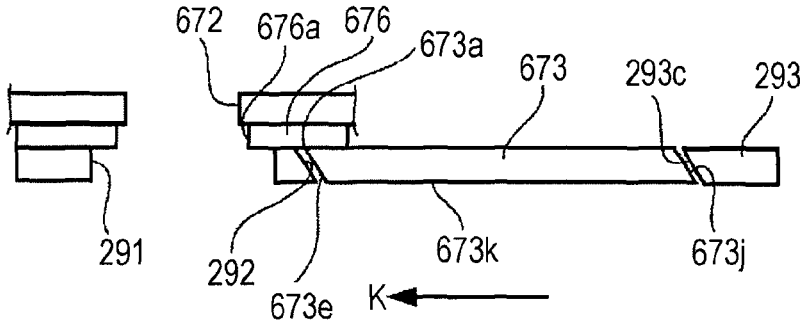
FIG. 12 is a diagram similar to FIGS. 8 to 11, illustrating a fifth exemplary embodiment in which the shutter member has a characteristic back end portion.

FIG. 12 is a diagram similar to FIGS. 8 to 11, illustrating a fifth exemplary embodiment in which the shutter member 673 has a characteristic back end portion, similar to the fourth exemplary embodiment.

In the fifth exemplary embodiment illustrated in FIG. 12, the shutter member 673 has an inclined surface 673*j* at the back end portion thereof. The retaining portion 293 has an inclined surface 293*c* that faces the inclined surface 673*j*. When the shutter member 673 is at the open position, the inclined surface 293*c* of the retaining portion 293 is placed on the inclined surface 673*j* of the shutter member 673. Therefore, similar to the fourth exemplary embodiment illustrated in FIG. 11, the back end 673*c* of the shutter member 673 is suppressed from being raised even when the front end portion of the shutter member 673 receives a force from the sealing member 676. As a result, the shutter member 673 may be reliably moved the closed position for closing the container opening 672 in the process of detaching the toner container 67.

Figure 13:
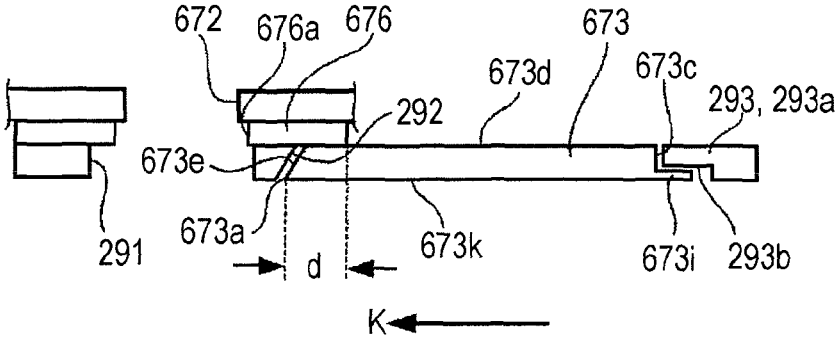
FIG. 13 is a diagram similar to FIGS. 8 to 12, illustrating a first exemplary embodiment in which the shutter member has characteristic front and back end portions.

FIG. 13 is a diagram similar to FIGS. 8 to 12, illustrating the first exemplary embodiment in which the shutter member 673 has characteristic front and back end portions.

In the first exemplary embodiment illustrated in FIG. 13, the shutter member 673 has the inclined surface 673*e* at the front end portion thereof, and the abutting portion 292 has the inclined surface. The inclined surface 673*e* and the abutting portion 292 are similar to those in the second exemplary embodiment illustrated in FIG. 9. Accordingly, the point of application of the force applied by the sealing member 676 may be shifted toward the back end 673*c* of the shutter member 673, so that the back end 673*c* of the shutter member 673 is suppressed from being raised. In addition, in the first exemplary embodiment illustrated in FIG. 13, the shutter member 673 has the projecting portion 673*i* at the back end portion thereof, and the retaining portion 293 has the step part 293*b*. The projecting portion 673*i* and the step part 293*b* are similar to those in the fourth exemplary embodiment illustrated in FIG. 11. The projecting portion 673*i* of the shutter member 673 is pressed from above by the step part 293*b* of the retaining portion 293, so that the back end 673*c* of the shutter member 673 is suppressed from being raised.

Accordingly, in the first exemplary embodiment illustrated in FIG. 13, the back end 673*c* of the shutter member 673 is reliably suppressed from being raised.

Figure 14:
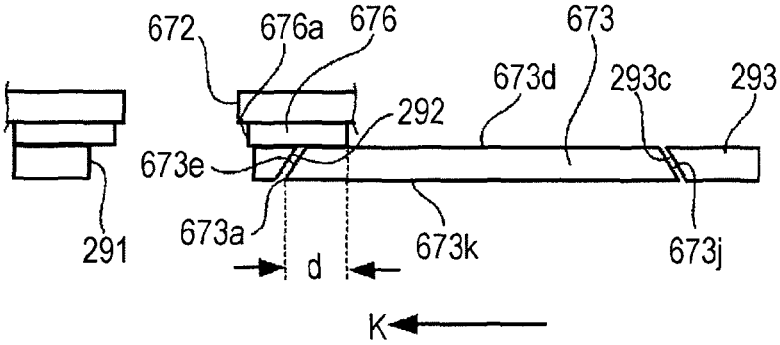
FIG. 14 is a diagram similar to FIGS. 8 to 13, illustrating a sixth exemplary embodiment in which the shutter member has characteristic front and back end portions.

FIG. 14 is a diagram similar to FIGS. 8 to 13, illustrating a sixth exemplary embodiment in which the shutter member 673 has characteristic front and back end portions, similar to the first exemplary embodiment illustrated in FIG. 13.

In the sixth exemplary embodiment illustrated in FIG. 14, the shutter member 673 has an inclined surface 673*e* at the front end portion thereof, and the abutting portion 292 has an inclined surface. The inclined surface 673*e* and the abutting portion 292 are similar to those in the second exemplary embodiment illustrated in FIG. 9. Accordingly, the point of application of the force applied by the sealing member 676 may be shifted toward the back end 673*c* of the shutter member 673, so that the back end 673*c* of the shutter member 673 is suppressed from being raised. In addition, in the sixth exemplary embodiment illustrated in FIG. 14, the shutter member 673 has an inclined surface 673*j* at the back end portion thereof, and the retaining portion 293 has the inclined surface 293*c*. The inclined surface 673*j* and the inclined surface 293*c* are similar to those in the fifth exemplary embodiment illustrated in FIG. 12. The inclined surface 673*j* of the shutter member 673 is pressed from above by the inclined surface 293*c* of the retaining portion 293, so that the back end 673*c* of the shutter member 673 is suppressed from being raised. Accordingly, in the sixth exemplary embodiment illustrated in FIG. 14, similar to the first exemplary embodiment illustrated in FIG. 13, the back end 673*c* of the shutter member 673 is reliably suppressed from being raised.

Although a copier illustrated in FIGS. 1 and 2 is described as an example, the present invention is not limited to copiers. The present invention may be applied to various types of image forming apparatuses, such as a printer or a facsimile machine, as long as toner is used in the developing process.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier on which a latent image is formed;

a developing device that develops the latent image formed on the image carrier with a toner;

a toner container that contains toner to be supplied and that is attached to a container support member by being moved in an attachment direction and detached from the container support member by being moved in a detachment direction that is opposite to the attachment direction;

the container support member that supports the toner container that has been attached to the container support member;

a toner supply unit that supplies the toner contained in the toner container to the developing device in accordance with consumption of the toner in the developing device;

a transfer device that transfers the toner image on the image carrier onto a recording medium;

a fixing device that fixes the toner image that has been transferred onto the recording medium to the recording medium; and a restricting mechanism, wherein the toner container includes a container housing having a container opening through which the toner in the toner container is discharged, a sealing member that is elastic and has a hole that communicates with the container opening, the sealing member being disposed in an area surrounding the container opening, and a shutter member that is slidable between a closed position at which the shutter member closes the container opening and an open position at which the shutter member opens the container opening and at which a front end portion of the shutter member in the attachment direction at least partially overlaps with the sealing member, the shutter member being moved to the open position when the toner container is attached to the container support member, the front end portion being pressed toward a direction away from the toner container by the sealing member when the front end portion partially overlaps with the sealing member, wherein the container support member has a support-member opening that is located so as to communicate with the container opening in the toner container when the toner container is attached to the container support member, and wherein when the shutter member is at the open position, the front end portion is pressed in a direction away from the toner container by the sealing member, and the restricting mechanism restricts a position of a back end portion of the shutter member, the back end portion being opposed to the front end portion.

2. The image forming apparatus according to claim 1, wherein the container support member includes an abutting portion that receives the front end portion of the shutter member when the toner container moves in the attachment direction, so that the shutter member is stopped from moving further in the attachment direction and caused to slide relative to the container housing to the open position, wherein the abutting member is shaped so as to be capable of being fitted in a gap between the sealing member and the front end portion of the shutter member, and the restricting mechanism is formed of the abutting portion and the shape of the front end portion of the shutter member.

3. The image forming apparatus according to claim 2, wherein the container support member further includes a retaining portion with which the shutter member interferes so as to elastically push the retaining portion when the toner container moves in the attachment direction, the retaining portion stopping the shutter member from sliding in the detachment direction when the shutter member is further moved in the attachment direction and the retaining portion is released from the interference with the shutter member, and wherein the retaining portion overlaps with the back end portion of the shutter member to restrict the back end portion from moving toward the toner container, and the restricting mechanism is formed of the retaining portion and the shape of the back end portion of the shutter member in addition to the abutting member and the shape of the front end portion of the shutter member.

4. The image forming apparatus according to claim 1, wherein the container support member includes a retaining portion with which the shutter member interferes so as to elastically push the retaining portion when the toner container moves in the attachment direction, the retaining portion stopping the shutter member from sliding in the detachment direction when the shutter member is further moved in the attachment direction and the retaining portion is released from the interference with the shutter member, and wherein the retaining portion overlaps with the back end portion of the shutter member to restrict the back end portion from moving toward the toner container, and the restricting mechanism is formed of the retaining portion and the shape of the back end portion of the shutter member.

5. A toner supply device comprising:

a toner container that contains toner to be supplied and that is attached to a container support member by being moved in an attachment direction and detached from the container support member by being moved in a detachment direction that is opposite to the attachment direction;

the container support member that supports the toner container that has been attached to the container support member;

a toner supply unit that supplies the toner contained in the toner container to a toner receiving member that receives the toner; and a restricting mechanism, wherein the toner container includes a container housing having a container opening through which the toner in the toner container is discharged, a sealing member that is elastic and has a hole that communicates with the container opening, the sealing member being disposed in an area surrounding the container opening, and a shutter member that is slidable between a closed position at which the shutter member closes the container opening and an open position at which the shutter member opens the container opening and at which a front end portion of the shutter member in the attachment direction at least partially overlaps with the sealing member, the shutter member being moved to the open position when the toner container is attached to the container support member, the front end portion being pressed toward a direction away from the toner container by the sealing member when the front end portion partially overlaps with the sealing member, wherein the container support member has a support-member opening that is located so as to communicate with the container opening in the toner container when the toner container is attached to the container support member, and wherein when the shutter member is at the open position, the front end portion is pressed in a direction away from the toner container by the sealing member, and the restricting mechanism restricts a position of a back end portion of the shutter member, the back end portion being opposed to the front end portion.

* * * * *